US009243509B2

(12) United States Patent
Hudson

(10) Patent No.: US 9,243,509 B2
(45) Date of Patent: Jan. 26, 2016

(54) STATOR VANE ASSEMBLY

(75) Inventor: Michael T. Hudson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 652 days.

(21) Appl. No.: 13/602,412

(22) Filed: Sep. 4, 2012

(65) Prior Publication Data

US 2014/0064945 A1 Mar. 6, 2014

(51) Int. Cl.
*F01D 9/04* (2006.01)

(52) U.S. Cl.
CPC ..... *F01D 9/042* (2013.01)

(58) Field of Classification Search
CPC ..... F01D 9/02; F01D 9/04; F01D 9/042; F01D 9/047; F01D 5/3007; F01D 11/001; F01D 11/005
See application file for complete search history.

(56) References Cited

U.S. PATENT DOCUMENTS

| | | | | |
|---|---|---|---|---|
| 4,500,255 | A | 2/1985 | Webb | |
| 7,086,827 | B2 | 8/2006 | Mokler | |
| 7,661,924 | B2 | 2/2010 | Wassynger et al. | |
| 7,686,576 | B2 | 3/2010 | Martin et al. | |
| 2004/0086383 | A1 * | 5/2004 | Couture et al. | 415/209.4 |
| 2005/0106005 | A1 | 5/2005 | Mokler | |
| 2008/0240912 | A1 | 10/2008 | Wassynger et al. | |
| 2009/0004000 | A1 | 1/2009 | Baumhauer et al. | |
| 2010/0028146 | A1 | 2/2010 | Martin et al. | |
| 2010/0061844 | A1 | 3/2010 | Hudson et al. | |
| 2010/0061850 | A1 | 3/2010 | Hudson et al. | |
| 2010/0064516 | A1 * | 3/2010 | Spracher et al. | 29/889.22 |
| 2010/0092283 | A1 | 4/2010 | Hudson et al. | |
| 2010/0092298 | A1 | 4/2010 | Hudson et al. | |

FOREIGN PATENT DOCUMENTS

| | | | |
|---|---|---|---|
| EP | 1508669 | A1 | 3/2007 |
| EP | 1978212 | A2 | 8/2008 |

* cited by examiner

*Primary Examiner* — Craig Kim
*Assistant Examiner* — Adam W Brown
(74) *Attorney, Agent, or Firm* — Sutherland Asbill & Brennan LLP

(57) ABSTRACT

The present application thus provides a stator vane assembly for a turbine engine. The stator vane assembly may include a casing slot and a number of ring segments positioned within the casing slot. Each of the ring segments may include a first end and a second end. The first end and the second end may have a stepped configuration.

5 Claims, 2 Drawing Sheets

STATOR VANE ASSEMBLY

TECHNICAL FIELD

The present application and resultant patent generally to gas turbine engines and more particularly relate to a stator vane assembly having stator ring segments with a stepped configuration to reduce aerodynamic moment transmitted from adjacent segments.

BACKGROUND OF THE INVENTION

Generally described, many compressors include stator vane assemblies with a number of stator vanes. Each of the stator vanes includes an airfoil that may extend from a dovetail slot. The stator vanes assemblies may be arranged between adjacent rows of rotor blades. The stator vane assemblies may include a number of stator rings coupled to circumferential slots in the compressor casing. A typical stator ring may be cut into a number of segments and then reassembled to create a 360 degree ring. The ends of these segments generally may have a straight cut while a stator vane dovetail slot may be angled to align with the vane skew angle.

For high solidity stator stages (i.e., high vane count stages), angled end cuts that match the skew angle of the stator vane dovetail slots may be used. Such an angled cut, however, may not effectively transmit tangential aerodynamic loads between adjacent ring segments. Rather, a moment may be created in the ring segment due to the aerodynamic loading of the stator vane. The angled cuts may force the ring segment to rotate within the casing slot so as to produce point loads between the ring segments and the casing and between the ring segments themselves. Such point loads may result in-excessive wear between the components.

There is thus a desire for an improved stator vane assembly. Such an improved assembly may minimize segment to casing wear as well as segment to segment wear due to ring rotation and the like. Reducing such wear may lead to lower overall maintenance and replacement costs for the stator vane assembly and other compressor components.

SUMMARY OF THE INVENTION

The present application and the resultant patent thus provide a stator vane assembly for a turbine engine. The stator vane assembly may include a casing slot and a number of ring segments positioned within the casing slot. Each of the ring segments may include a first end and a second end. The first end and the second end may have a stepped configuration.

The present application and the resultant patent further provide a stator vane assembly for a turbine engine. The stator vane assembly may include a casing slot and a number of ring segments positioned within the casing slot. Each of the ring segments may include a first portion and a second portion. The first portion may have a straight cut and the second portion may have an angled cut.

The present application and the resultant patent further provide a ring segment for use with a stator vane assembly. The ring assembly may include a first end, a second end, and a number of dovetail slots therebetween. The first end and the second end may include a stepped configuration.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
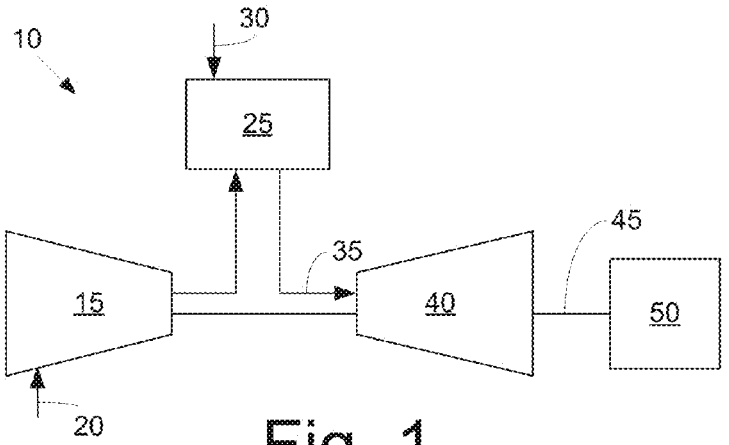
Fig. 1 Prior Art
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
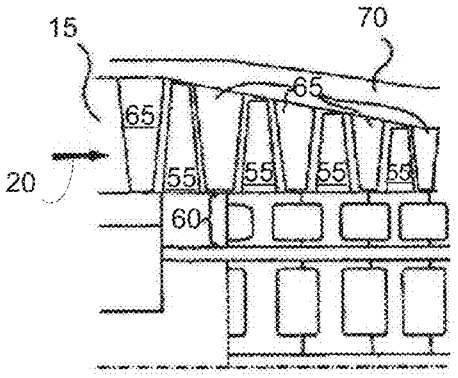
Fig. 2 Prior Art
FIG. 2 is a schematic diagram of a portion of a known compressor showing a number of stages.

FIG. 2 shows a schematic diagram of an example of the compressor 15. The compressor 15 may include any number of stages with each stage including a number of circumferentially spaced rotor blades 55 coupled to a rotor wheel 60 and a number of circumferentially spaced stator vanes 65 couple to a static compressor casing 70. During operation, the rotating rotor blades 55 cooperate with the stationary stator vanes 65 to impart kinetic energy to the flow of air 20 therethrough. Other types of compressor configurations may be used.

Figure 3:
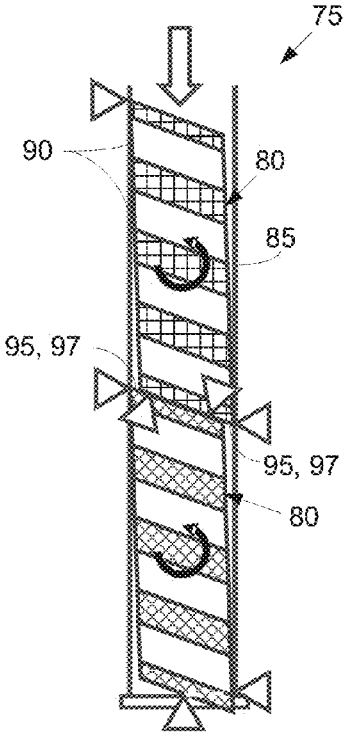
Fig. 3 Prior Art
FIG. 3 is a schematic diagram of a known stator vane assembly as may be used with the compressor of FIG. 2.
Figure 4:
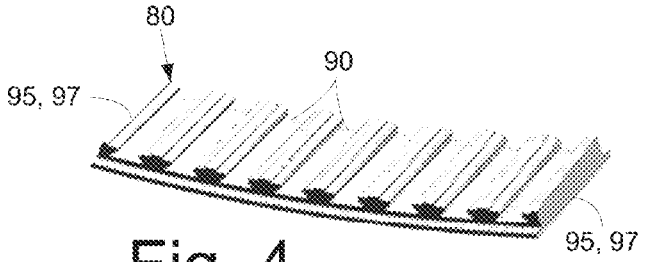
Fig. 4 Prior Art
FIG. 4 is a perspective view of a segment of the stator vane assembly of FIG. 3.

FIGS. 3 and 4 show a stator vane assembly 75 that may be used within the compressor 15. The stator vane assembly 75 may position the stator vanes 65 about the casing 70. The stator vane assembly 75 may include a number of ring segments 80 positioned within a casing slot 85. Any number of ring segments 80 may be used. Each of the ring segments 80 may have a number of dovetail slots 90 therein for positioning the stator vanes 65. The dovetail slots 90 generally may be angled.

Each of the ring segments 80 also may have a pair of ends 95 in communication with the ends 95 of adjacent ring segments 80. In the case of high vane count or high solidarity stator stages, the ends 95 may include an angled cut 97. As described above, however, the angled cuts 97 may force the ring segments 80 to rotate within the casing slot 85 so as to result in point loads and wear between the segments 80 and the casing 85 as well as between the segments 80 themselves. Specifically, the angled cuts 95 may produce point loads $L_P$ of axial, tangential, and key reaction as well as transferred momentum. The transferred momentum may cause the segments 80 to twist so as to result in the point loads $L_P$.

Figure 6:
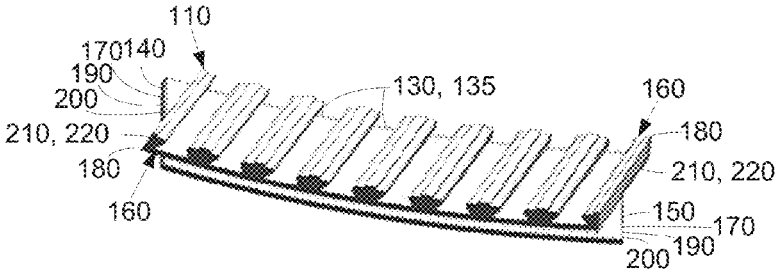
FIG. 6 is a perspective view of a segment of the stator vane assembly of FIG. 5.
Figure 5:
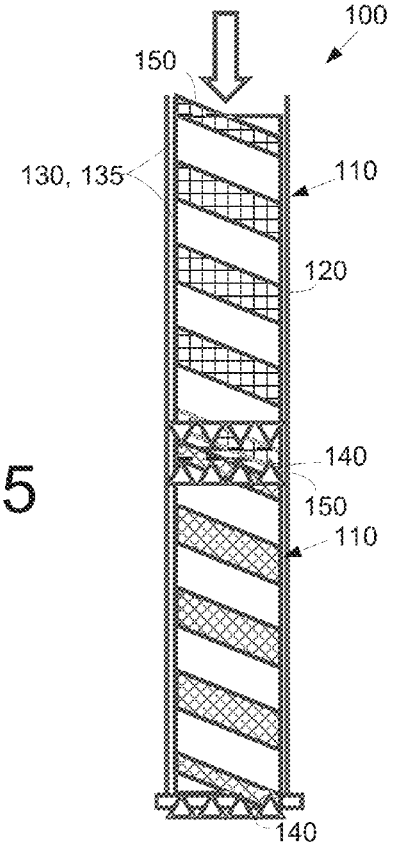
FIG. 5 is a schematic diagram of a stator vane assembly as may be described herein.

FIGS. 5 and 6 show a stator vane assembly 100 as may be described herein. The stator vane assembly 100 also may include a number of ring segments 110. Any number of the ring segments 110 may be used herein in creating a 360 degree ring. The ring segments 110 may be positioned within a casing slot 120. Each of the ring segments 110 may have a number of dovetail slots 130 therein for positioning the stator vanes 65. Any number of the dovetail slots 130 may be used herein. The dovetail slots 130 may have an angled configuration, i.e., a dovetail angle 135. Other components and other configurations may be used herein.

Each ring segment 110 also includes a first end 140 and a second end 150. Both ends 140, 150 may have a stepped configuration 160. The stepped configuration 160 may include a bottom or a first portion 170 and a top or a second portion 180. The bottom or first portion 170 may have a straight cut thereon. The straight cut 190 may be largely perpendicular to the direction of the ring segments 110 and the casing slot 120. The straight cut 190 creates a flat surface 200 so as to provide for uniform loading conditions with adjacent ring segments 110 and the casing slot 120. Specifically, the flat surface 200 may transmit aerodynamic loads between adjacent ring segments 110. The top or second portion 180 may include an angled cut 210. The angled cut 210 may have an end angle 220. The end angle 220 may be aligned substantially with the dovetail angle 135 of the dovetail slots 130 although the degree of the end angle 220 of the angled cut 210 may vary. The angled cut 210 thus may accommodate high solidity or high vane count stages and the like. Other components and other configurations may be used herein.

Use of the stepped configuration 160 with both the straight cut 190 and the angled cut 210 thus accommodates vane stagger and the transfer of tangential force. As a result, little or no moment or twists may be imposed on the ring segments 110. Moreover, axial reaction or point load may be reduced or eliminated. Such uniform loading should reduce ring wear and improve durability. The stepped configuration 160 may have other combinations and other configurations of the first portion 170 and the second portion 180 and the angles inbetween.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A stator vane assembly for a turbine engine, comprising:

a casing slot; and a plurality of ring segments positioned within the casing slot;

each of the plurality of ring segments comprising a first end, a second end, and a plurality of dovetail slots positioned at a dovetail angle between the first end and the second end;

the first end and the second end of each of the plurality of ring segments comprising a stepped configuration having a first portion and a second portion, wherein the first portion of the stepped configuration comprises a straight cut and the second portion of the stepped configuration comprises an angled cut, and wherein the angled cut comprises an end angle that substantially equals the dovetail angle and is formed by at least a portion of an outer edge opposite of one of the plurality of dovetail slots at the first end or the second end.

2. The stator vane assembly of claim 1, wherein the first portion comprises a flat surface.

3. The stator vane assembly of claim 1, further comprising a plurality of stator vanes positioned about each of the plurality of ring segments.

4. The stator vane assembly of claim 1, wherein the stepped configuration comprises a bottom straight cut and an upper angled cut.

5. A ring segment for use with a stator vane assembly, comprising:

a first end;

a second end;

a plurality of dovetail slots positioned at a dovetail angle therebetween; and the first end and the second end comprising a stepped configuration having a first portion and a second portion, wherein the first portion of the stepped configuration comprises a straight cut and the second portion of the stepped configuration comprises an angled cut, and wherein the angled cut comprises an end angle that substantially equals the dovetail angle and is formed by at least a portion of an outer edge opposite of one of the plurality of dovetail slots at the first end or the second end.

* * * * *